US009332869B1

(12) United States Patent
Beaudette

(10) Patent No.: US 9,332,869 B1
(45) Date of Patent: May 10, 2016

(54) SHOE AND ORTHOSIS DONNING AID

(71) Applicant: Arthur J Beaudette, Syracuse, NY (US)

(72) Inventor: Arthur J Beaudette, Syracuse, NY (US)

( * ) Notice: Subject to any disclaimer, the term of this patent is extended or adjusted under 35 U.S.C. 154(b) by 0 days.

(21) Appl. No.: 14/868,440

(22) Filed: Sep. 29, 2015

(51) Int. Cl.
*A47G 25/80* (2006.01)

(52) U.S. Cl.
CPC ..... *A47G 25/80* (2013.01)

(58) Field of Classification Search
CPC ..... A47G 25/80; A47G 25/82; A47G 25/84; A47G 25/845; A47G 25/86
USPC ..... 223/113, 114, 117
See application file for complete search history.

(56) References Cited

U.S. PATENT DOCUMENTS

| | | | | | |
|---|---|---|---|---|---|
| 8,865 | A * | 4/1852 | Thomson | A47G 25/80 | 223/117 |
| 459,680 | A | 9/1891 | Donauer | | |
| 612,764 | A * | 10/1898 | Anderson | A47G 25/80 | 223/117 |
| 1,748,643 | A * | 2/1930 | Folsom | A47G 25/80 | 223/115 |
| 2,603,393 | A * | 7/1952 | Oblusteel | A47G 25/80 | 12/120.5 |
| 3,012,702 | A * | 12/1961 | Van Der Vliet | A47G 25/82 | 223/113 |
| 3,035,289 | A * | 5/1962 | Wakeman | A43D 95/00 | 12/120.5 |
| 4,289,122 | A | 9/1981 | Mason et al. | | |
| 4,587,962 | A | 5/1986 | Greene et al. | | |
| 4,666,070 | A | 5/1987 | McClung | | |
| 4,683,876 | A | 8/1987 | Changras | | |
| 4,908,897 | A * | 3/1990 | Sadlak | A63C 11/00 | 12/120.5 |
| 5,806,729 | A | 9/1998 | Ramon | | |
| 5,897,515 | A | 4/1999 | Willner et al. | | |
| 6,409,692 | B1 | 6/2002 | Covey | | |
| 6,689,081 | B2 | 2/2004 | Bowman | | |
| 8,474,666 | B2 | 7/2013 | Vitillo et al. | | |
| 2006/0020233 | A1 | 1/2006 | Bremer | | |

FOREIGN PATENT DOCUMENTS

| | | | | |
|---|---|---|---|---|
| FR | 2851444 A1 * | 8/2004 | ..... | A47G 25/80 |

OTHER PUBLICATIONS

Orthotic Shop, AFO Drop Foot Braces/www.orthoticshop.com Jul. 31, 2015.
Acrylonitrile butadiene styrene, Wikipedia, the free encyclopedia, Aug. 15, 2015.

* cited by examiner

*Primary Examiner* — Nathan Durham
(74) *Attorney, Agent, or Firm* — Bernhard P. Molldrem, Jr.

(57) ABSTRACT

An aid or device for assisting a person in putting on his or her shoes when the person uses an ankle-foot orthosis (AFO) has a generally flat platform or frame on which the shoe rests. A toe strap or restraint holds the toe of the shoe, and an elastic or spring-biased cord at the heel end has a clip or hook that attaches to the upper part of the orthosis. A handle at the toe-end or distal end extends upwards and permits the wearer to manipulate the donning aid with the shoe and orthosis so he or she can don the shoes without assistance of others. The donning aid can be formed from a sheet of ABS material with suitable cutouts for toe restraint and hand-hold.

16 Claims, 8 Drawing Sheets

SHOE AND ORTHOSIS DONNING AID

FIELD OF THE INVENTION

The present invention relates to an aid for assisting a person in putting on his or her shoes, particularly when the person must use an ankle-foot orthosis or AFO device.

BACKGROUND OF THE INVENTION

Ankle-foot orthoses or drop-foot braces are often needed by persons suffering from foot drop. Foot drop occurs when the muscles or tendons of the ankle or foot which participate in the upward and downward movements of the ankle can no longer lift the toes upward when walking. With this condition, the foot tends to slap down onto the floor, and the person can experience foot dragging on the affected foot. There are a number of causes for this condition, but all result in difficulty walking or in conducting normal day to day functions.

To compensate for the drop foot condition, a health care provider may prescribe a special brace, i.e., an ankle-foot orthosis or AFO, to push the sole of the foot upwards relative to the ankle so that the foot is in a normal horizontal position instead of being angled downwards. This may be used on the patient either with or without surgery or other therapy.

Most commonly, the device is worn within the shoe, with a foot plate that is under the heel and sole of the foot to help keep the foot level. An associated channel portion extends up from the ankle and secures to the calf of the person's leg. A leaf-spring or coil-spring arrangement may be to bias the foot plate upwards, and yet permit the person to push his foot downward. These can make it easier for the person to operate the accelerator and brake pedal of a motor vehicle.

The orthosis is typically inserted into the shoe before the person inserts his foot into the shoe, but this can make it very difficult for the person to put his or her shoes on. Most often a second person's assistance is required any time the person has to get dressed or undressed.

Accordingly, a shoe donning aid has been needed, that is, a device that makes it possible for the wearer to manipulate the shoe and the orthosis on his own to facilitate inserting his or her foot into the shoe, and which allow him or her to do this maneuver quickly and easily without assistance.

OBJECTS AND SUMMARY OF THE INVENTION

It is an object of the present invention to provide a simple-to-use, rugged, and reliable aid for donning a shoe and AFO orthotic foot brace, without another person's assistance and without undue difficulty.

It is another object to a shoe-and-orthosis donning aid that allows the person to manipulate the position of the shoe and the orthosis so that he or she can easily insert the foot into the orthosis and into the shoe on his own.

It is an object that the aid be of simple, rugged design and be easy for the person to use and manipulate.

It is a further object to provide a shoe-and-orthosis donning aid that can be collapsed for storage or for travel.

In accordance with an aspect of the present invention, a shoe-and-orthosis donning aid has a base, i.e., a shoe support formed as a generally rigid platform adapted or configured to support the shoe into which an ankle-foot orthosis has been inserted. In that case the calf portion of the orthosis projects upwards from the heel end of the shoe. A distal end or toe end of the shoe support is positioned to be beneath the toe portion of the shoe and a proximal end thereof extends to or beyond a heel end of the shoe. A toe restraint, which can be a cup or a surrounding strip or belt, is disposed at the distal end of the shoe support and is properly shaped and constructed for releasably capturing the toe portion of the shoe to block movement in the distal direction and to hold the toe portion down against the shoe support. A handle riser, which can take the form of at least one upwardly extending bar, and favorably a pair of upright bars, can be rigidly supported on the shoe support and have a grip portion affixed onto an upper and thereof. In some cases, the bar or bars can be attached to the shoe support platform by means of a lockable hinge arrangement so the bar or bars can be collapsed down against the shoe support for storage or travel.

An extensible elastic member is fastened at one end onto said shoe support at the proximal end thereof, i.e., behind the position of the heel of the shoe. The elastic member has a hook or clamp member attached at its free end. The clamp member releasably engages with the upper end of the calf portion of the AFO. The tension in the elastic member bends the orthosis rearward under tension of the elastic member. This places the orthosis and shoe into a position where the user can slide his or her foot into the channel of the calf portion and then into the shoe. The handle or grip on the upright bar or bars allows the user to manipulate the donning aid so that the shoe and orthosis are in an optimum position for him to insert his foot into the shoe. Once this is accomplished, the wearer can release the clamp and elastic member from the top back of the orthosis, and then he or she can apply the strap or binding on the orthosis to secure it onto his calf.

Favorably, the toe restraint is in the form of a flexible belt forming a loop and having ends secured to the shoe support. Alternatively, it can take the form of a cup. This element should cross over the toe portion of the shoe upper so as to maintain the toe against the shoe support.

The rigid bar or bars can be constituted as a pair of parallel bars extending upward from the distal end of the shoe support, and the grip portion may have its ends attached to respective upper ends of the pair of bars. The bars can be of any suitable cross section and need not be straight, so long as they enable the wearer to manipulate and adjust the position of the shoe and orthosis donning aid during the process of donning the shoe.

In a favorable embodiment the extensible elastic member can take the form of an elastic cord, e.g., bungee, having one end anchored to the proximal end of the shoe support, and the clamp member can take the form of a hook affixed onto a free end of the elastic cord. This part of the arrangement can employ a spring instead of a bungee cord, so long as it can apply a tensile force onto the top of the orthosis and pull rearwardly it into position for donning.

Favorably also, an optional lower riser member may be affixed onto a base of the shoe support at the distal end thereof to orient the shoe support tilted upward when it is set on the floor. A non-slip material may be applied to an underside of the shoe support and to an underside of the riser lower member.

An alternative embodiment may be formed from a sheet of ABS plastic sheet or other suitable tough polymer. The shoe support formed from the ABS plastic sheet as a generally rigid platform adapted to support the shoe into which an ankle-foot orthosis has been inserted with a calf portion of the orthosis projecting upwards. Here, the generally rigid handle riser can be an upwardly extending panel that is unitarily formed of the same ABS material at a distal end of said shoe support, and has a grip portion formed at an upper and, and a toe restraint cutout formed at a lower end thereof and adapted for releasably capturing the toe portion of the shoe. A bungee or other extensible elastic member has one end anchored onto the proximal end of the shoe support, and has a hook member attached onto the elastic member for releasably engaging an upper end of the calf portion of said orthosis. This serves for flexing the orthosis rearward under tension of the elastic member. The anchor member that attaches the extensible elastic member to the shoe support or platform can be a solid pin with a through hole and another member attaching the one end of cord, or can be a hollow or tubular pin that is crimped to secure the one end of the elastic restraining cord.

Alternatives and variations of this shoe donning aid or device are also possible, following the main principles of this invention. The main aspects of the invention will become apparent from the ensuing description of a preferred embodiment, given in connection with the accompanying Drawing figures.

DETAILED DESCRIPTION OF THE PREFERRED EMBODIMENT

Figure 1:
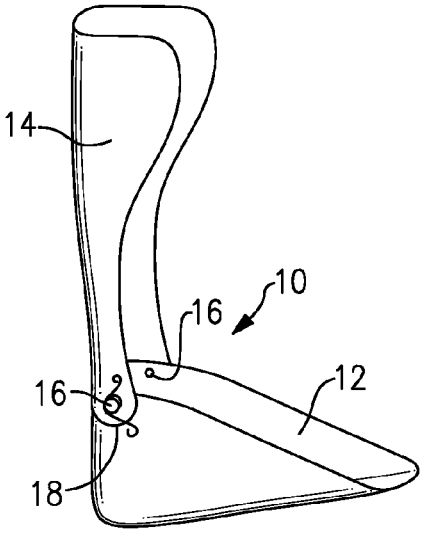
FIG. 1 is a perspective view of a typical foot-ankle orthosis.
Figure 2:
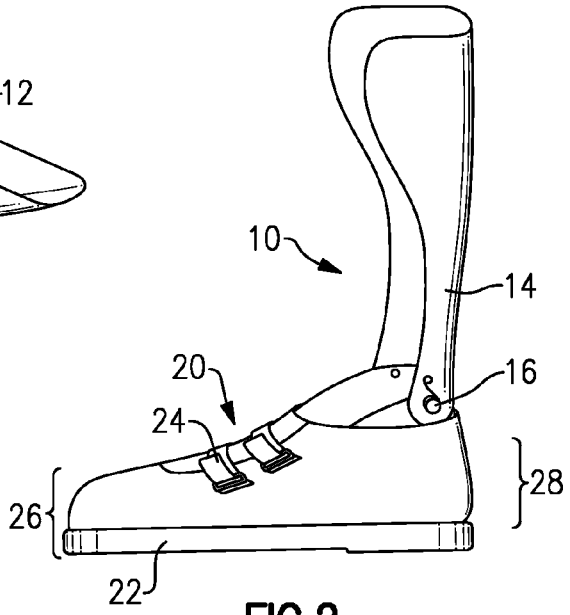
FIG. 2 is a perspective view of a shoe with the orthosis inserted therein prior to donning of the shoe and orthosis.

Referring now to FIGS. 1 and 2, a typical ankle-foot orthosis (AFO) or drop-foot brace 10 has a foot plate or sole plate 12 that supports the wearer's foot sole, and a calf portion 14 that extends upwards from above the wearer's heel. The calf portion 14 is typically a generally part-cylindrical channel to fit around the wearer's calf and may have a strap or fastener to secure it to the wearer's lower leg. In this particular example of an AFO there is a hinge or pivot 16 corresponding to the location of the wearer's ankle to permit flexing at the ankle, and one or more springs, here a coil spring 18, to effect an upward bias as between the calf portion 14 and the sole plate 12 to assist the wearer in keeping his or her foot more-or-less level. The pivot 16 allows the wearer to push his or her foot downward when needed, for example in operating the foot pedals of a motor vehicle. There are a number of different designs of AFO, and some employ a leaf spring or other mechanism to permit flexing.

The preferred method for the wearer to put his or her shoes on, i.e., don the shoes, is first to insert the AFO 10 into the shoe 20, as shown in FIG. 2, and then slip his or her foot into the AFO while it is in place in the shoe.

Here the shoe 20 is shown to have a sole 22 and upper 24, with a toe portion 26 at a front or distal end and a heel portion 28 at the rear or proximal end. The spring 16 tends to bias the calf portion 14 of the AFO 10 so that it is leaning somewhat forward, i.e., towards the toe portion 26 of the shoe 20.

Figure 3:
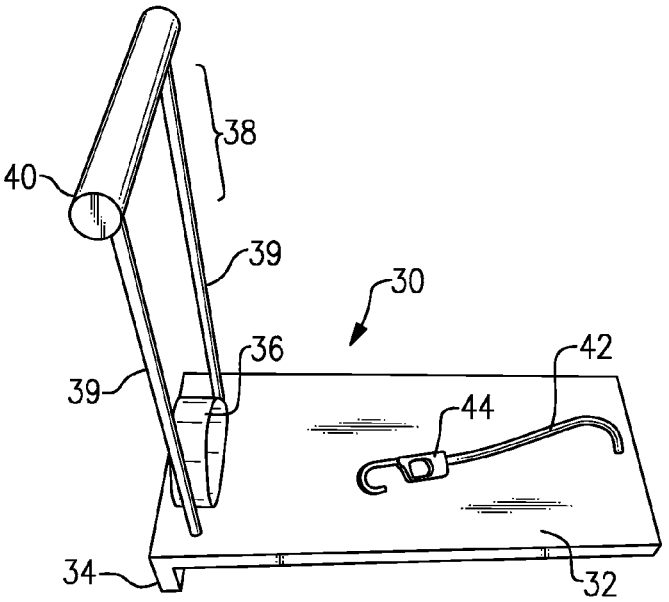
FIG. 3 is a side perspective view of the shoe donning aid according to one embodiment of the invention.
Figure 4:
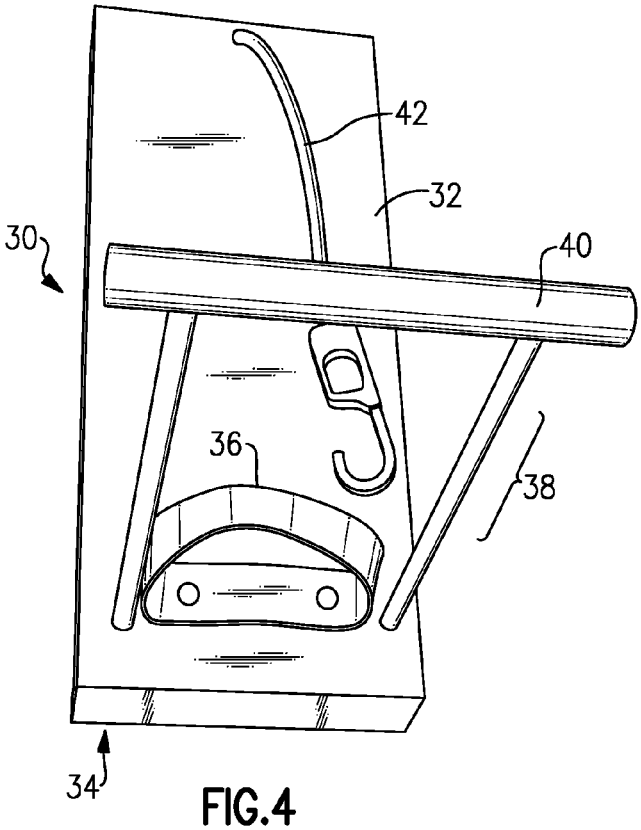
FIG. 4 is a perspective view thereof from the front or distal end and above.
Figure 5:
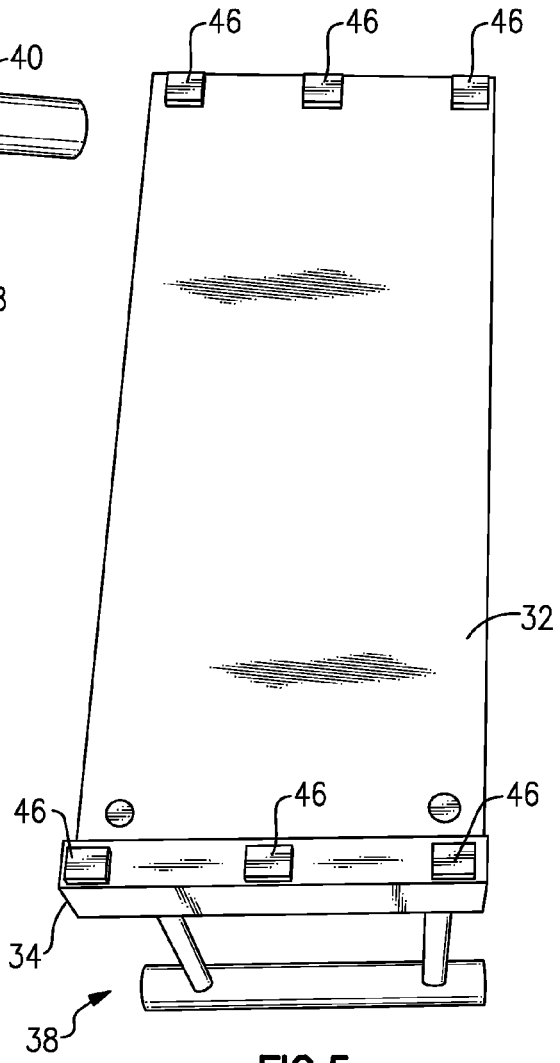
FIG. 5 is a perspective view of the aid inverted to feature the base or bottom side.

A shoe and orthosis donning aid 30 according to one embodiment of the invention is shown in FIGS. 3, 4, and 5. A generally flat shoe support or platform 32 can be formed an elongated, generally rigid panel or board of wood, plastic, or metal of sufficient length and width to support the wearer's shoe 20. In this embodiment, the toe restraint 36 can be in the form of a loop of a leather strap fastened, e.g., by screw fasteners, to the shoe support, although other designs of toe restraints are possible. A riser member 34 positioned at the base or underside of the shoe support 32 the front or distal end elevates the toe end or distal end of the shoe support 32. A toe restraint 36 is affixed onto the shoe support 32 near the distal end fits the toe end 26 of the shoe and blocks the shoe toe from forward, sideways, and upward motion relative to the shoe support 32. A handle 38 is rigidly attached to the distal end of the shoe support 32 extends generally upward. Here the handle 38 is formed of a pair or vertical rods or bars 39 that are anchored to the distal end of the shoe support 32 on either side of the toe restraint 36, with a horizontal grip 40 affixed to upper ends of the two vertical bars 39. An elastic restraining cord 42 is anchored at the proximal or heel end of the shoe support 32. A clip or hook member 44 is affixed at the other end of the core 42. Here the clip or hook member 44 has a hook portion and a generally circular finger grip. The elastic cord in this specific embodiment may be a bungee cord, but other elastic members can be employed to exert a rearward or backward force onto the calf portion 14 of the AFO 10. In practice, the cord 42 can be about six inches in length and the hook portion up to about fourteen inches out from the shoe support 32, with sufficient pull to bend the orthosis to the angle shown in the figures. As shown in FIG. 5, one or more strips or patches of a non-slip material 46, e.g., rubber sheeting, are affixed onto the base or bottom side 48 of the shoe support 32 and at the underside of the riser 34. These help prevent undesired slipping of the device 30 on the floor when used for donning the shoe and orthosis.

In this embodiment the shoe support 32 has a length of about sixteen inches and a width of about seven inches, and the handle 38 extends up about twelve to fourteen inches above the shoe support. The riser 34 provides an elevation of about one-and-one-half inches at the toe end of the shoe support. This can vary depending on shoe size and depending on the individual. The cord 42 is anchored to the shoe support 32 at a point about three inches behind the heel 28 of the shoe.

Figure 6:
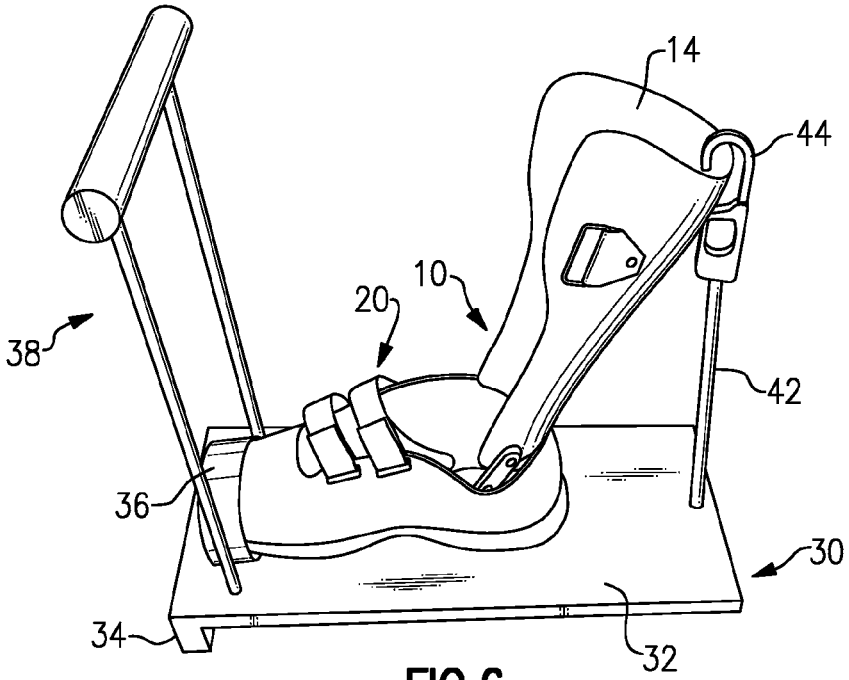
FIG. 6 shows the wearer's shoe and orthosis mounted on the aid and ready for the wearer to insert his foot into the orthosis and shoe.
Figure 7:
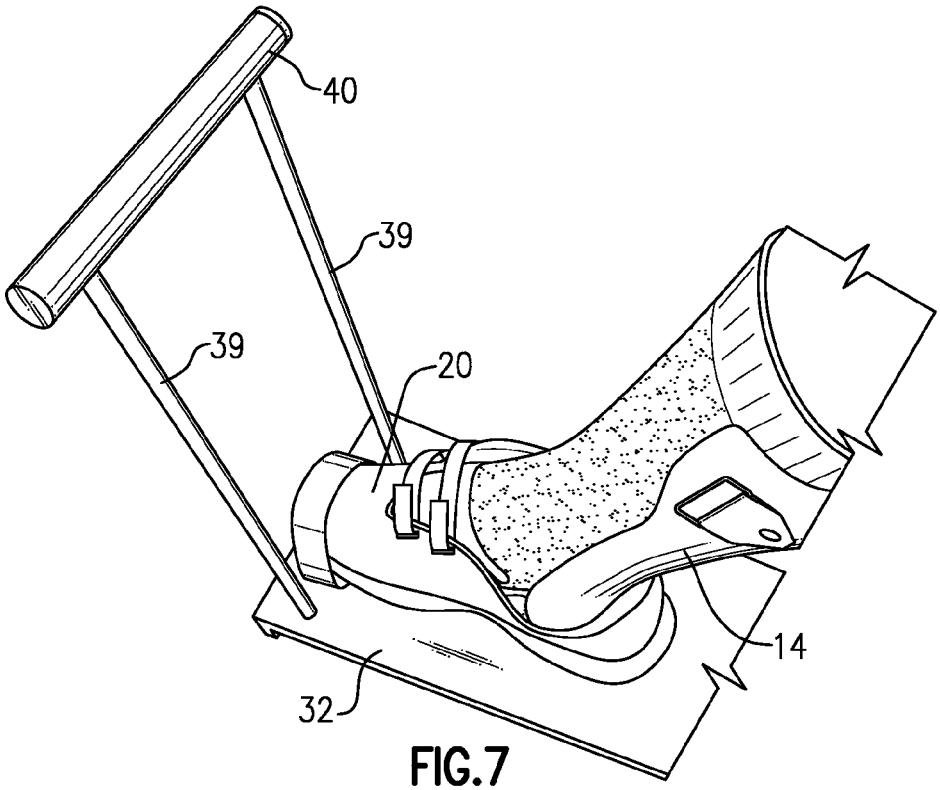
FIG. 7 shows the shoe and orthosis on the aid, after the wearer has inserted his or her foot into the shoe and orthosis.

A favorable technique for donning the shoe 20 and orthosis 10 is illustrated in FIGS. 6 and 7. After inserting the orthosis 10 into the shoe 20, the wearer places the shoe 20 so that the toe portion 26 is inserted into the toe restraint 36. Then, the wearer can pull the hook or clamp 44 of the elastic cord 42 out and upward, and place it on the back and top of the orthosis calf portion 14. This will pull the calf portion 14 so that it is angled back behind the heel 28 of the shoe.

Donning the shoe involves first grasping the grip 40 of the handle 38, and then manipulating the donning aid 30 and shoe 20 so that the shoe and orthosis are in a position to allow the wearer to slip his foot into the shoe with his calf sliding into the calf portion of the orthosis. This results in the wearer's lower leg and foot being in the shoe and orthosis as illustrated in FIG. 7. At this point, the wearer can disconnect the clamp or hook 44 from the orthosis, and slide the shoe out of the toe restraint 36. Then he or she can tie the shoe laces or fasten the shoe straps (depending on the particular shoe design). With the handle positioned ahead of the shoe, there are no obstructions at the sides of the donning aid 30, and the user can slide the foot off to either side. The wearer can repeat these simple steps to put on the other shoe (if an orthosis is required for the other foot).

Figure 8:
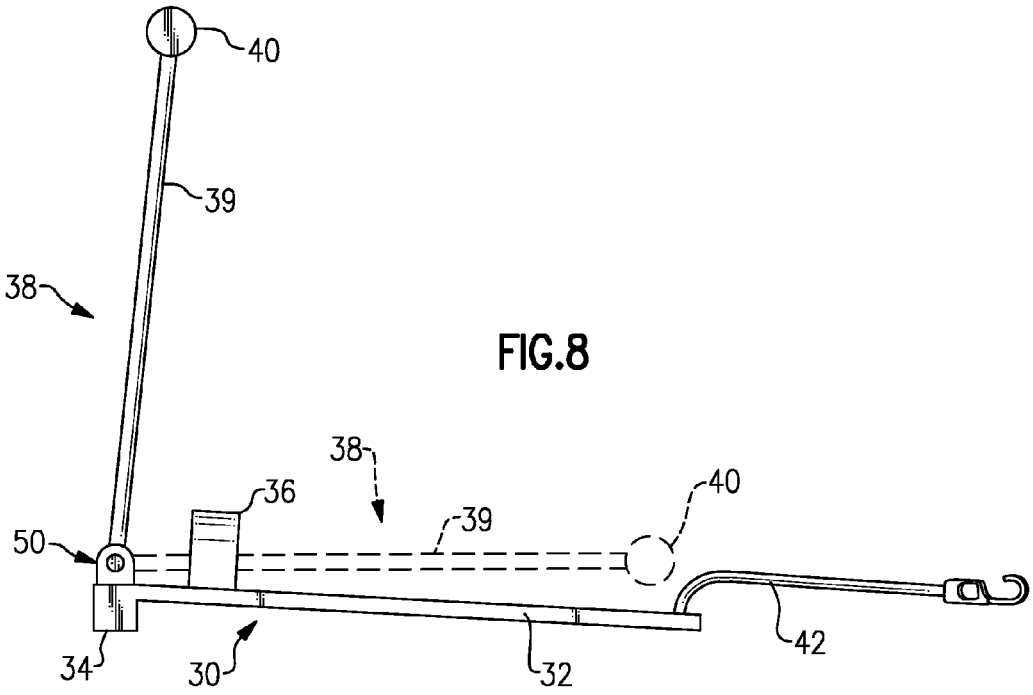
FIG. 8 shows an alternative embodiment, with a fold-down handle bar.

FIG. 8 is a side elevation showing a modification or variation of the shoe-and-orthosis donning aid 30. Here, the handle 38 is shown with each of its vertical rods or bars 39 ending in respective a locking hinge 50 that is affixed onto the shoe support on either side of the toe restraint 36. For use, the handle 38 is upright, with the hinge 50 locked into an upright position (shown in solid line). When the wearer is finished putting his or her shoes on, the locking hinge or hinges can be released, and the handle 38 folded down (as shown in broken line) for travel or storage.

Figure 9:
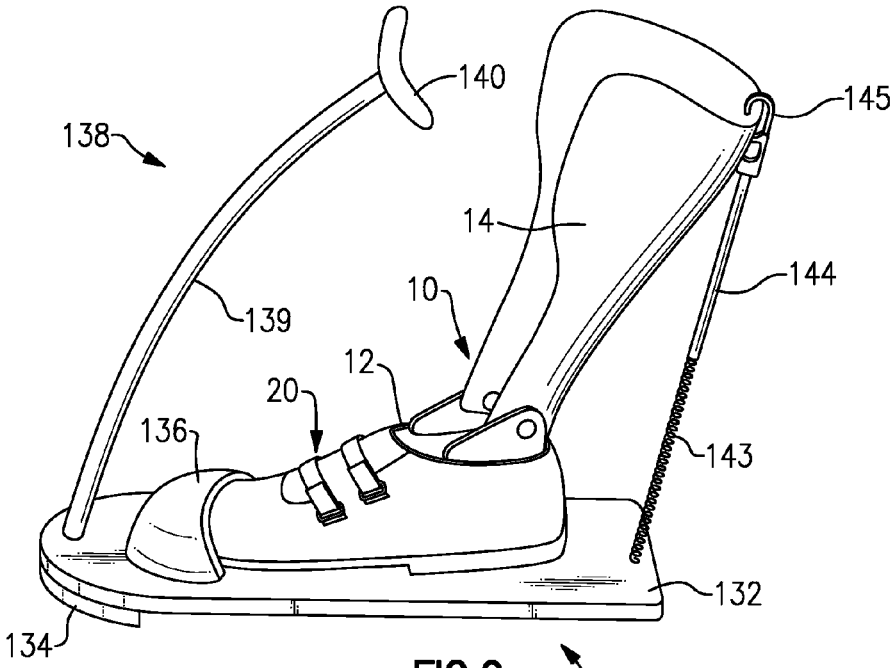
FIG. 9 is a perspective view of an alternative embodiment.

Shoe donning aids or similar devices that follow the principles of this invention need not be the same shape and construction as in the above-described embodiments. One possible alternative embodiment is illustrated in FIG. 9 where elements that correspond to the above-described embodiments are identified with similar reference numbers, but raised by 100. Here the shoe donning aid 130 has an elongated shoe support 132 that is rounded in profile and has a single-post or single-bar handle 138, with the bar 139 curving both upwards and somewhat back or proximally to its associated handle grip 140. The elastic restraining cord 142 here is formed of a coil tension spring 143 attached to the proximal end of the shoe support 132. A lanyard 144 is attached to the spring 143, with a clamp member 145 being affixed at the end of the lanyard 144. Other equivalent designs are possible for the elastic restraint, capable of exerting a rearward and downward force onto the calf portion of the AFO to position it so that the wearer can more easily slip his or her foot into the orthosis and shoe. Here, the toe restraint 136 is in the form of a cup or hood rather than a belt or strap.

In other equivalent embodiments, shoe support 32 can take the form of a more-or-less open frame capable of supporting the sole and heel of the shoe and holding the shoe toe within the toe restraint.

Figure 10:
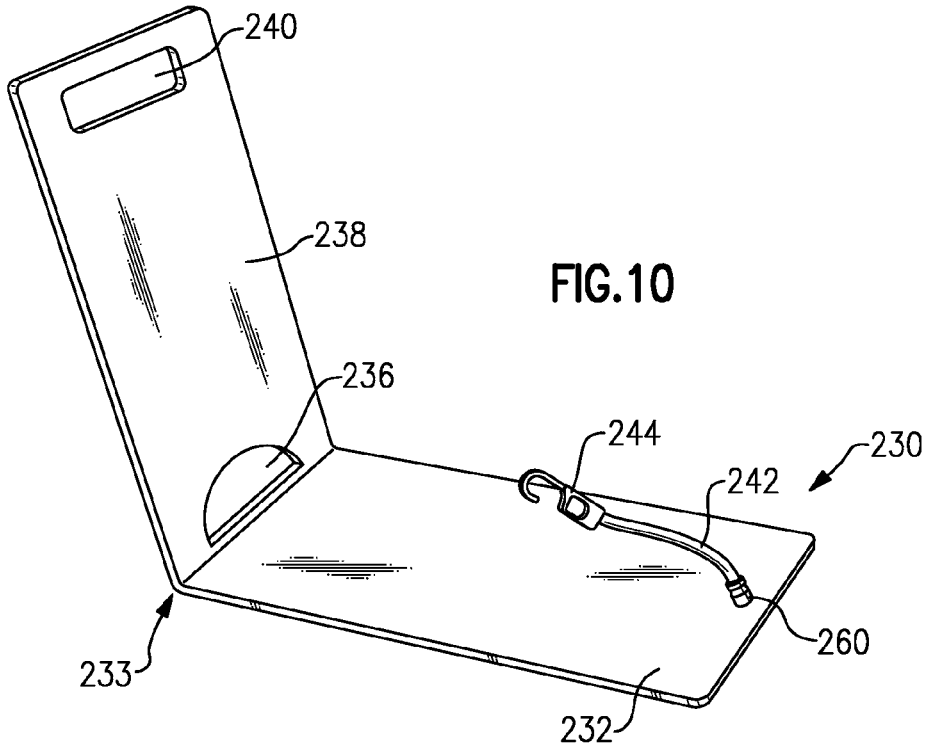
FIGS. 10 and 11 are perspective views for illustrating another preferred embodiment of the invention.
Figure 11:
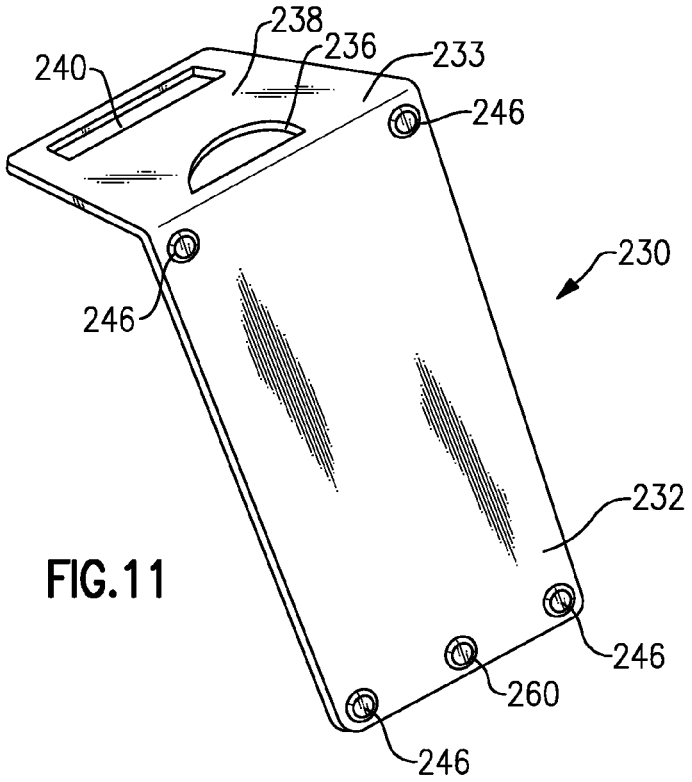

Another preferred embodiment of the shoe and orthosis donning aid 230 is shown in FIGS. 10 to 15. In this case, the donning aid 230 is formed from a unitary sheet of ABS, i.e., acrylonitrile-butadiene-styrene terpolymer, which is a tough but lightweight and resilient plastic resin. The preferred material is black utility grade ABS of 6 mm thickness. Other colors are available. The sheet material can be textured on the upper side to assist in gripping the shoe sole. As illustrated in FIGS. 10 and 11, the donning aid is L-shaped in profile with a shoe support or platform 232 and an upright panel 238 that are joined at a ninety-degree bend 233. A riser is omitted in this embodiment. A toe restraint is formed as a half-moon shaped cut-out 236 at the lower part of the panel 238, just above the bend 233, and a hand-hold cut-out 240 is formed as a generally horizontal opening near the upper end of the panel 238. A bungee cord 242 serving as the elastic restraining cord has one end anchored or affixed into an anchor member 260 at the proximal end of the platform 232, and has a hook member 244 attached on its free end. As in the earlier embodiment(s), the hook member 244 has a hook portion and a round finger hold to assist in getting the hook member 244 on and off the calf portion 14 of the orthosis.

As shown in FIG. 11, there are non-slip buttons or pads 246 affixed onto the corners of the underside of the platform or shoe support 232.

Figure 12:
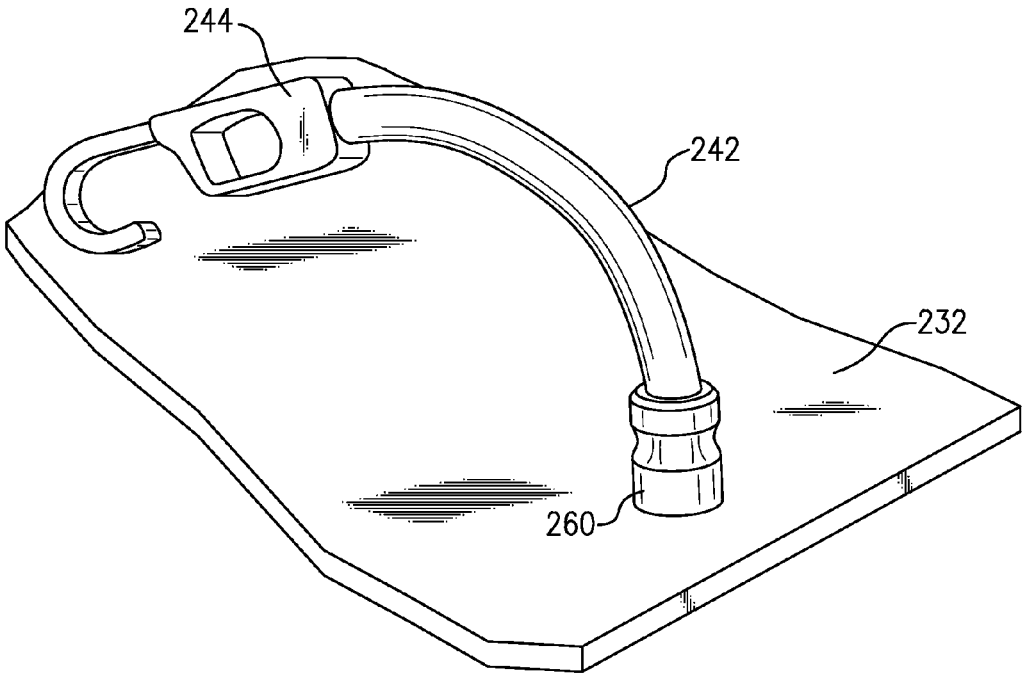
FIG. 12 is an enlarged view illustrating an anchor portion of this embodiment.

As illustrated in FIG. 12, a preferred version of the anchor member 260 takes the form of a tubular member that is positioned in a round aperture in the proximal end of the shoe support or platform 232. On end of the cord 242 is inserted into the tubular anchor member 260, and then the tubular member is crimped to hold the cord 242 securely. An available crimping tool is used for this purpose. The lower end of the tubular member, at the underside of the platform 232, is expanded or flared out to secure it onto the platform.

Figure 13:
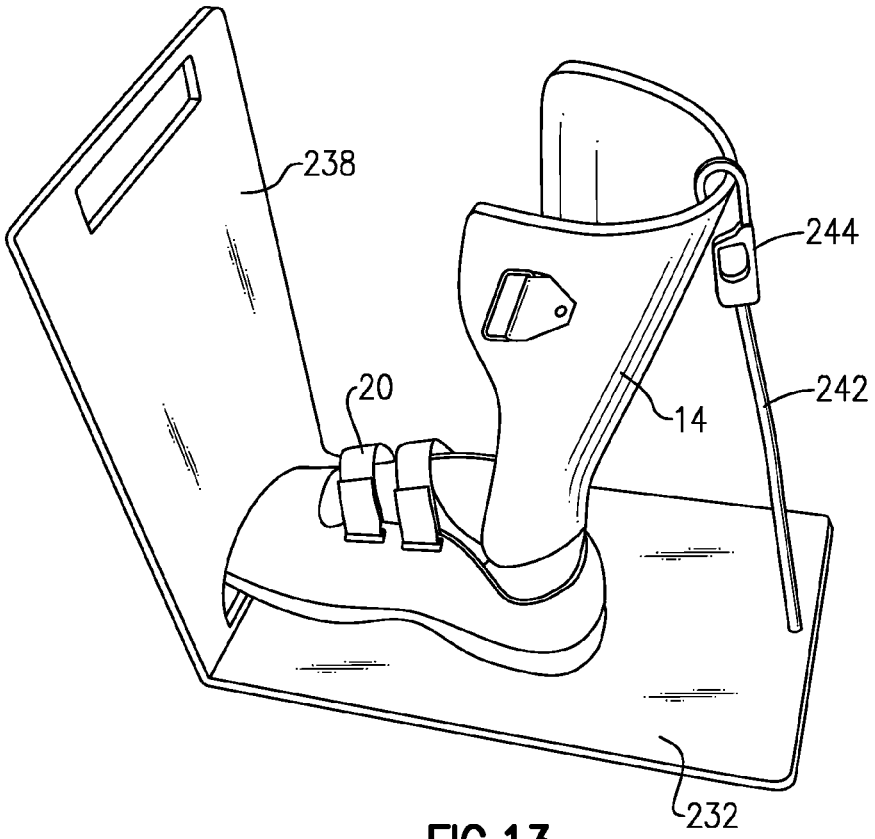
FIGS. 13 and 14 are perspective views illustrating the manner of employing the donning aid of this invention.

FIG. 13 illustrate the employment of the donning aid 230 of this embodiment in assisting the user with the shoe 20 and associated AFO orthosis 10. The technique is similar to that discussed earlier in reference to the prior embodiment.

First, the orthosis 10 is inserted into the shoe 20, and then shoe is placed onto the platform 232 of the donning aid 230, with the toe of the shoe inserted into the toe-restraint cut-out 236, as shown. After this, the restraining bungee cord 242 is pulled up so that the hook member 244 engages the upper edge of the calf portion 14 of the orthosis.

At this point, the user can grasp the hand-hold opening 240 and manipulate the donning aid 230 so that the shoe and orthosis are positioned so he or she can slip the foot, with stocking, into the orthosis and into the shoe. After this, the hook member 244 is disengaged with the calf portion 14 of the AFO, and the user can remove his shoe-clad foot from the donning aid 230. The shoe can be laced up or closed. Then the user can proceed to perform the same technique with the other shoe and other foot. The entire procedure only takes about one to two minutes for each foot.

Figure 15:
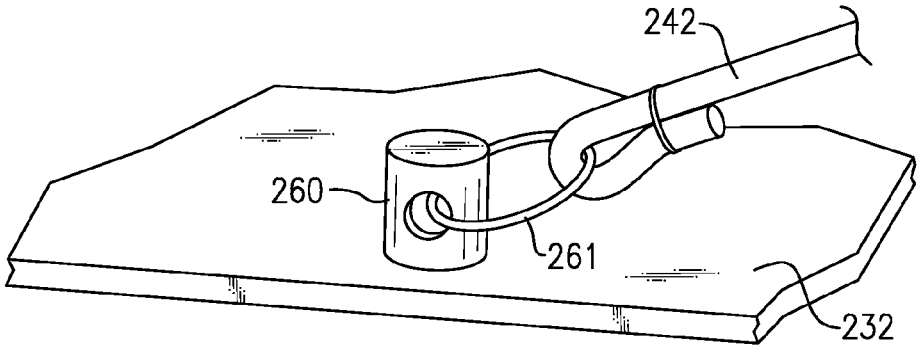
FIG. 15 is another view illustrating an alternative anchor portion.
Figure 14:
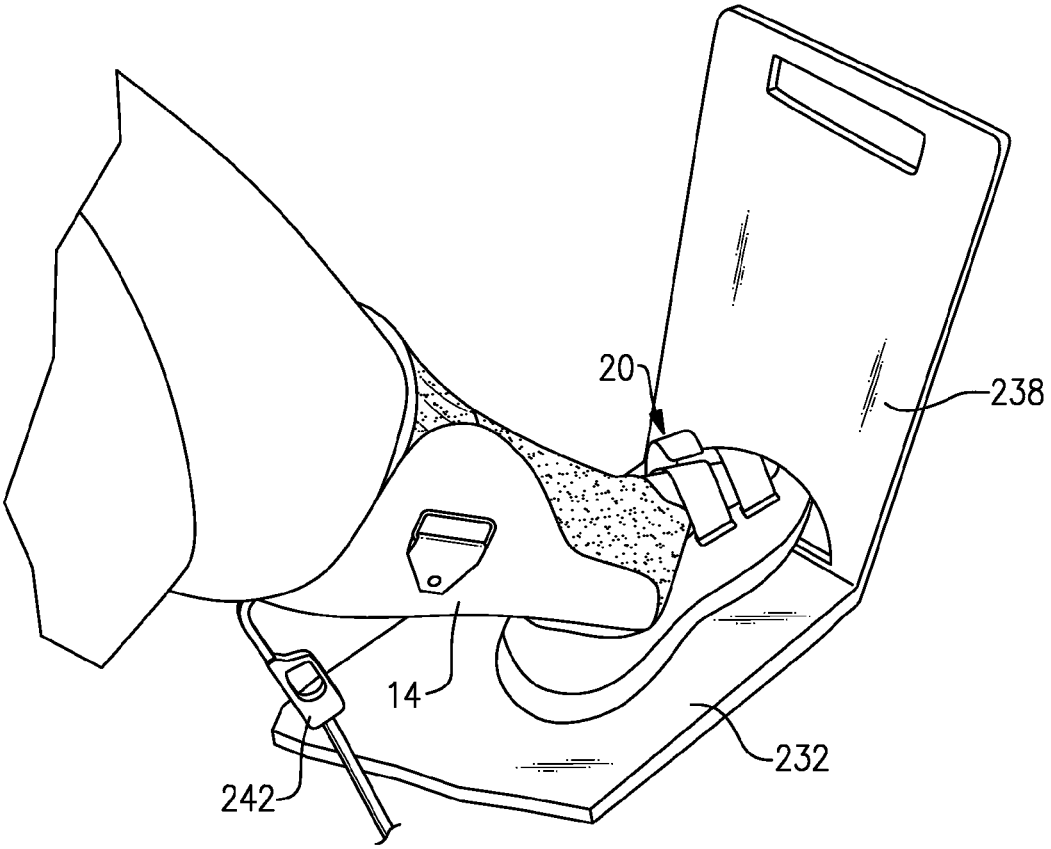

FIG. 15 illustrates one alternative anchor mechanism for attaching the end of the restraining bungee cord 242. In this case, a solid pin 260' penetrates a hole in the shoe support platform 232, and the solid pin 260' has a transverse through-opening, with a metal ring or loop 261 going through the pin 260' and also attaching to that end of the restraining bungee cord. The pin 260' can have a flanged end at the underside of the platform 232.

The foregoing description and drawings present several embodiments of this invention and variations thereof for the purpose of explaining the invention. However, the invention is not limited to the disclosed embodiments, but rather many modifications and variations thereof would present themselves to persons skilled in the art without departing from the scope and spirit of the invention as defined in the appended Claims.

What is claimed is:

1. A shoe-and-orthosis donning aid comprising:

a shoe support formed as a generally rigid panel having an upper surface adapted to support a wearer's shoe into which an ankle-foot orthosis has been inserted with a calf portion of the orthosis projecting upwards; and with a distal end of the shoe support supporting a toe portion of the shoe and with a proximal end thereof supporting a heel end of the shoe;

a toe restraint disposed at the distal end of the shoe support and adapted for releasably capturing the toe portion of the shoe to block motion thereof in the distal direction and to hold the toe portion down against the shoe support;

a generally rigid handle riser supported on said shoe support and having a grip portion affixed onto an upper and thereof; and an extensible elastic member anchored onto said shoe support at the proximal end thereof, and having clamp member attached onto the elastic member for releasably clamping onto an upper end of the calf portion of said orthosis for flexing the orthosis rearward under tension of the elastic member.

2. The shoe-and-orthosis donning aid according to claim 1 in which the toe restraint is in the form of a flexible belt forming a loop and having ends secured to the distal end of said shoe support.

3. The shoe-and-orthosis donning aid according to claim 1 wherein said handle riser includes a pair of parallel bars extending upward from the distal end of the shoe support, and wherein said grip portion has ends attached to respective upper ends of the pair of bars.

4. The shoe-and-orthosis donning aid according to claim 1 wherein said handle riser includes a releasable hinge member disposed at the distal end of the shoe support having a locked condition for holding the rigid bar in an upward position, and an unlocked condition permitting the rigid bar to be folded down onto the shoe support.

5. The shoe-and-orthosis donning aid according to claim 1 wherein said extensible elastic member is in the form of an elastic cord having one end anchored to the proximal end of the shoe support.

6. The shoe-and-orthosis donning aid according to claim 5 wherein said clamp member is in the form of a hook affixed onto a free end of said elastic cord.

7. The shoe-and-orthosis donning aid according to claim 1, comprising a riser member affixed onto a base of said shoe support at the distal end thereof to orient the shoe support tilted upward.

8. The shoe-and-orthosis donning aid according to claim 7, comprising a non-slip material applied to an underside of the shoe support and to an underside of said lower riser member.

9. A shoe-and-orthosis donning aid comprising:

a shoe support formed as a generally rigid panel having an upper surface that is adapted to support a wearer's shoe into which an ankle-foot orthosis has been inserted with a calf portion of the orthosis projecting upwards; and with a distal end of the shoe support supporting a toe portion of the shoe and with a proximal end thereof supporting a heel end of the shoe;

an upwardly extending handle riser constituted as a panel unitarily formed at a distal end of said shoe support and having a grip portion formed at an upper and thereof, and a toe restraint cutout formed at a lower end thereof and adapted for realizable capturing the toe portion of the shoe to block motion thereof in the distal direction and to hold the toe portion down against the shoe support; and an extensible elastic member anchored onto said shoe support at the proximal end thereof, and having hook member attached onto the elastic member for realizable engaging an upper end of the calf portion of said orthosis for flexing the orthosis rearward under tension of the elastic member.

10. The shoe-and-orthosis donning aid according to claim 9 in which said shoe support and said upwardly extending panel are unitarily formed from a sheet of a suitable plastic resin.

11. The shoe-and-orthosis donning aid according to claim 10 wherein said sheet of utility grade ABS plastic has a thickness of substantially 6 mm.

12. The shoe-and-orthosis donning aid according to claim 9 wherein said shoe support and said upwardly extending panel are unitarily formed from a sheet of utility grade ABS plastic.

13. The shoe-and-orthosis donning aid according to claim 9 comprising an anchor member penetrating the shoe support at a proximal end thereof, and engaging one end of said extensible elastic member.

14. The shoe-and-orthosis donning aid according to claim 13, wherein said anchor member is in the form of a tubular pin with said one end of said extensible elastic member inserted therein and with the pin being crimped to secure the one end of the extensible elastic member.

15. The shoe-and-orthosis donning aid according to claim 13 wherein said anchor member is in the form of a pin having a transverse through-hole therein, and including a member passing through the through-hole and securing the one end of the extensible elastic member.

16. The shoe-and-orthosis donning aid according to claim 9 comprising a non-slip material applied to an underside of the shoe support.

* * * * *